US005230752A

United States Patent [19]

Bourgain et al.

[11] Patent Number: 5,230,752

[45] Date of Patent: Jul. 27, 1993

[54] FERRITIC STAINLESS STEEL AND PROCESS FOR PRODUCING SUCH A STEEL

[75] Inventors: Pierre Bourgain, Vernouillet; Jean-Claude Bavay, Isbergues, both of France

[73] Assignee: Ugine, Aciers de Chatillon et Gueugnon, Puteaux, France

[21] Appl. No.: 761,924

[22] PCT Filed: Mar. 13, 1990

[86] PCT No.: PCT/FR90/00169

§ 371 Date: Sep. 13, 1991

§ 102(e) Date: Sep. 13, 1991

[87] PCT Pub. No.: WO90/10723

PCT Pub. Date: Sep. 20, 1990

[30] Foreign Application Priority Data

Mar. 16, 1989 [FR] France ..... 89 03472

[51] Int. Cl.[5] ..... C22C 38/20; C22C 38/22; C21D 8/00

[52] U.S. Cl. ..... 148/325; 148/610; 420/61

[58] Field of Search ..... 148/12 EA, 32 S, 610; 420/61

[56] References Cited

FOREIGN PATENT DOCUMENTS

| | | | |
|---|---|---|---|
| 0057316 | 8/1982 | European Pat. Off. . | |
| 2091642 | 1/1972 | France . | |
| 50-109809 | 8/1975 | Japan | 420/61 |
| 465999 | 6/1937 | United Kingdom . | |
| 2075549 | 11/1981 | United Kingdom . | |

*Primary Examiner*—Deborah Yee

*Attorney, Agent, or Firm*—Cushman, Darby & Cushman

[57] ABSTRACT

A process and combination for ferritic stainless steel resisting corrosion in neutral or weakly acid chloride-containing media, being ductile and impact resistant, the compositions consisting essentially of 28.5 to 35% chromium, 3.5 to 5.5% molybdenum, 0.5 to 2% copper, less than 0.5% nickel, less than 0.4% manganese, less than 0.4% silicon, less than 0.030% carbon, less than 0.030% nitrogen, and of titanium and/or niobium between 0.10 to 0.60% where % Ti>0.2+4(% C)+3.4(% N) and/or % Nb>0.1+7.7(% C)+6.6(% N) is satisfied. The process if for production of steel strips of the above composition where the hot-rolled steel strip is tempered at 900 to 1200° C., then subjected to a first cold rolling followed by an intermediate and final tempering at 900 to 1200° C. after intermediate and final cold rollings.

5 Claims, 5 Drawing Sheets

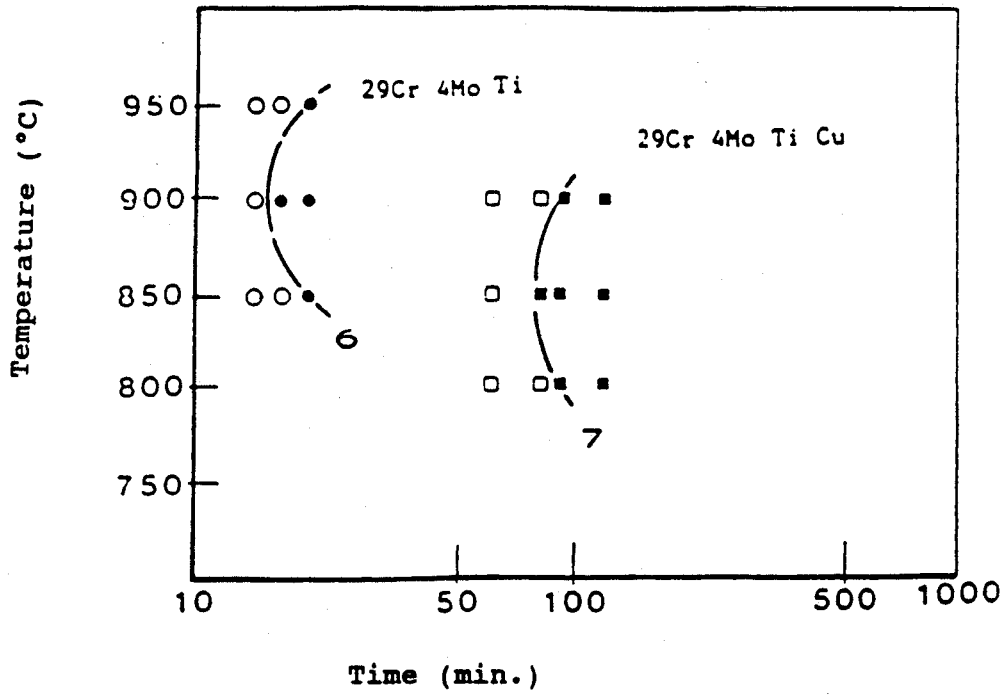
○ □ no precipitation
● ■ precipitation embrittling phases
FIG. 8
FIG. 9
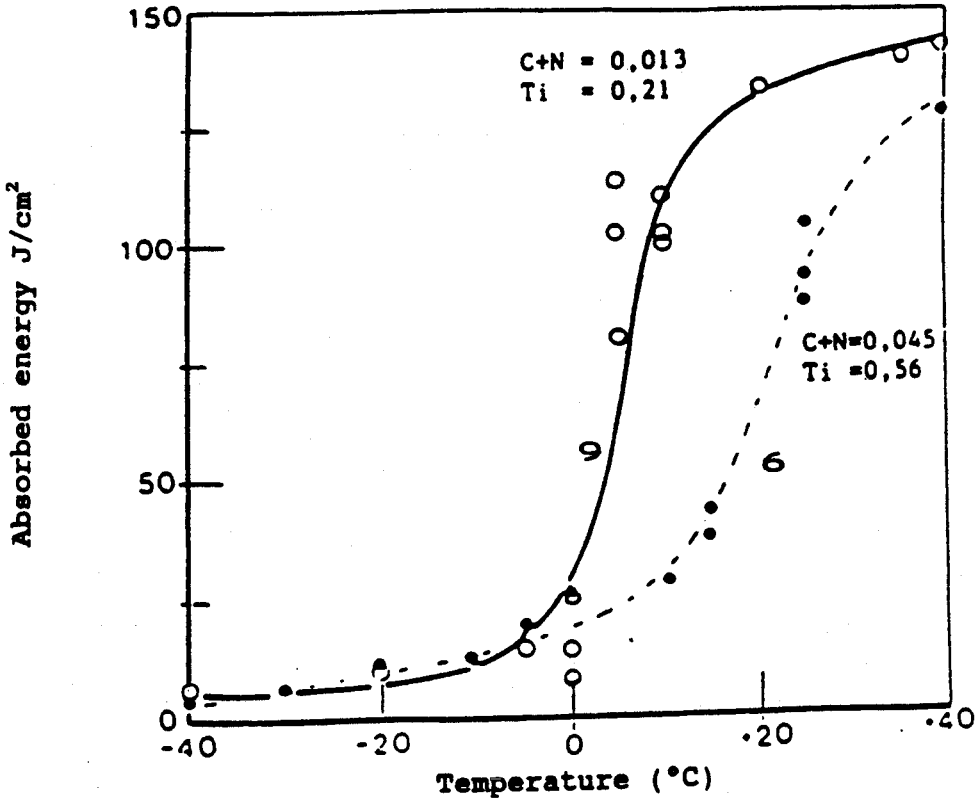

FERRITIC STAINLESS STEEL AND PROCESS FOR PRODUCING SUCH A STEEL

The present invention relates to a ferritic stainless steel which is highly resistant to corrosion in a neutral or weakly acidic chloride-containing medium and more particularly suited for the manufacture of heat exchangers for industry, especially those cooled by brackish water or seawater.

A process for the production of such a steel is also a subject of the present invention.

FR-A-2,377,457 discloses a chromium nickel molybdenum ferritic steel resisting corrosion and containing especially from 18 to 32% of chromium, from 0.1 to 6% of molybdenum, from 0.5 to 5% of nickel and not more than 3% of copper.

Examples of steel which are described in this document relate to steels containing 1.99 to 2.15% of molybdenum. Furthermore, it is stated on page 9, lines 27 to 32, that the steels exhibiting the best alloy compositions are those containing 28% of chromium, 2% of molybdenum and 4% of nickel, and those containing 20% of chromium, 5% of molybdenum and 2% of nickel, because they have a sufficient structural stability and can be manufactured economically on an industrial scale.

FR-A-2,352,893 also discloses a ferritic stainless steel containing from 0.01 to 0.025% by weight of carbon, from 0.005 to 0.025% by weight of nitrogen, from 20 to 30% by weight of chromium, from 3 to 5% of molybdenum, from 3.2 to 4.8% of nickel, from 0.1 to 1% of copper, from 0.2 to 0.7% of titanium and/or from 0.2 to 1% of niobium.

This document claims more particularly a high nickel content of between 3.2 to 4.8% in combination with a limitation on the copper content of between 0.1 and 1% to obtain high ductility values at room temperature.

FR-A-2,473,069 also discloses an iron-based ferritic stainless steel containing up to 0.08% by weight of carbon, up to 0.060% by weight of nitrogen, from 25 to 35% by weight of chromium, from 3.60 to 5.60% by weight of molybdenum, up to 2% by weight of nickel and up to 2% by weight of titanium, niobium and zirconium according to the following equation:

$$Ti/6+\%\ Zr/7+\%\ cb/8>\%\ C+\%\ N$$

The sum of the said carbon and nitrogen being greater than 0.0275% by weight.

FR-A-2,473,068 discloses a ferritic stainless steel which has the same composition as the above steel, but whose weight content of nickel is between 2 and 5%.

Now, it is known that nickel is a costly element which accelerates the formation of embrittling intermetallic phases and reduces resistance to cavity corrosion in a chloride-containing medium.

The subject of the present invention is therefore a ferritic stainless steel in which the addition of copper is limited to a value of 0.5 to 2% by weight so as to reinforce the impact strength of the alloy while reducing the rate of formation of hard and embrittling intermetallic phases of the sigma and chi type which can form during the heat treatments of manufacture of the welding. This results in the possibility of producing an alloy stabilised with titanium and/or with niobium with a very high content of chromium and of molybdenum, essential for obtaining a maximum corrosion resistance while reducing to a minimum the difficulties of manufacture and the risk of deterioration in the other final properties.

This result is obtained by the invention by virtue of a ferritic stainless steel which has the following chemical composition by weight:

28.5 to 35% of chromium,
3.5 to 5.50% of molybdenum,
0.5 to 2% of copper,
less than 0.50% of nickel,
less than 0.40% of manganese,
less than 0.40% of silicon,
less than 0.030% of carbon,
less than 0.030% of nitrogen,
a percentage of titanium and/or niobium of at least 0.10% and lower than 0.60%
and containing up to 0.10% of elements added for deoxidation, such as aluminium, magnesium, calcium, boron and rare-earth materials, the remainder being iron and impurities resulting from the melting of the substances needed for the production.

According to another characteristic of the invention the steel contains less than 0.010% of carbon and less than 0.015% of nitrogen, the sum of the carbon and nitrogen being less than 0.025%.

A further subject of the invention is a process for the production of a ferritic stainless steel from which a steel strip is formed, which is rolled hot, characterised in that the hot-rolled steel strip is subjected to tempering at a temperature of between 900 and 1200° C. and the steel strip is then subjected to a first cold rolling followed by an intermediate tempering at a temperature of between 900 and 1200° C. and finally the steel strip is subjected to a second cold rolling followed by a final tempering at a temperature of between 900 and 1200° C.

According to other characteristics of the invention:

the intermediate tempering and the final tempering are performed continuously for 20 seconds to 5 minutes, the temperings are followed by a rapid cooling.

The characteristics and advantages of the invention will emerge, furthermore, from the diagrams attached to the figures.

BRIEF DESCRIPTION OF THE DRAWINGS

FIG. 8 is a plot of time to appearance of embrittlement phases versus the 750 to 950° C. temperature range for 29% Cr 4% Mo 1% Ti alloy with and without 1% copper. This plot shows that 1% copper delays appearance of embrittlement phases in the 750 to 950° C. temperature region.

FIG. 9 is a ploy of impact strength (absorbed energy) versus temperature for an alloy of 29% Cr 4% Mo 0.21% Ti where C+N=0.013% and for an alloy of 29% Cr 4% Mo 0.56% Ti where C+N =0.045%. The plot shows that, for 2 mm thick sheets of stainless steel, on lowering the C+N content making it possible to reduce percent Ti needed to fix the carbon and nitrogen, impact strength is improved and the rate of formation of embrittling phases was decreased.

Figure 1:
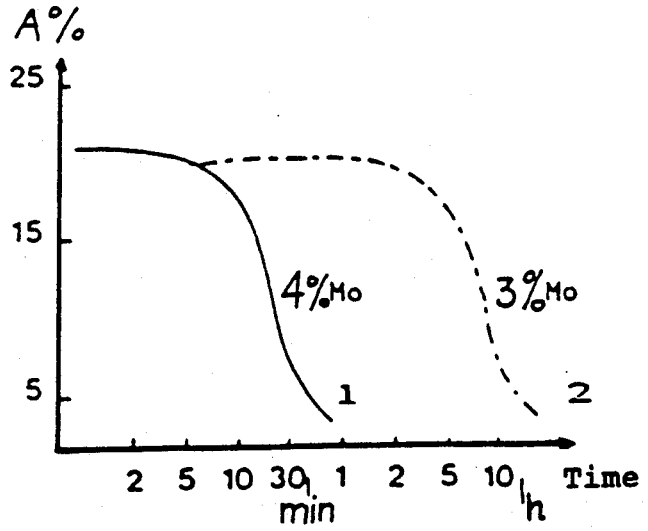
FIG. 1 is a plot of percent elongation at break at room temperature versus time of holding the sample steel sheets at 900° C. for an alloy with 29% Cr 3% Mo 2% Ni 1% Nb and an alloy with 29% Cr 3% Mo 2% Ni 1% Nb, on a weight percent basis.

The examples illustrating the present invention were obtained from 30-kg ingots produced using an induction furnace under vacuum. Small slabs originating from these ingots were heated between 1100 and 1250° C. with a view to hot rolling to a thickness of 5 mm.

The hot-rolled strips are then subjected to tempering between 1000 and 1200° C. followed by cold rolling to a thickness of 2 millimetres. After this cold rolling a tempering of the order of 20 s to 5 min is performed continuously at a temperature of between 900 and 1200° C.

An additional cold rolling makes it possible to obtain strips with a thickness of 0.8 millimetres which are then subjected to a final tempering of the order of 20 s to 5 min and at a temperature of between 900 and 1200° C.

All the heat treatments are followed by rapid cooling. The heat treatment conditions are adapted so as to make the grain size substantially constant.

Precise chemical analyses, that is to say the weight percentages of the experimental alloys are detailed in the table below:

TABLE 1

| Number | Description | C | Si | S | Mn | Cr | Ni | Mo | Ti | Nb | Cu | N |
|---|---|---|---|---|---|---|---|---|---|---|---|---|
| 1 | 29Cr 4Mo 2Ni Nb | 0.020 | 0.21 | 0.003 | 0.18 | 29.01 | 2.03 | 3.95 | ≦0.01 | 0.52 | 0.04 | 0.022 |
| 2 | 29Cr 3Mo 2Ni Nb | 0.020 | 0.23 | 0.003 | 0.22 | 29.35 | 2.03 | 3.00 | ≦0.01 | 0.53 | 0.03 | 0.020 |
| 3 | 29Cr 4Mo 4Ni Ti | 0.029 | 0.21 | 0.009 | 0.19 | 29.02 | 3.98 | 3.96 | 0.41 | ≦0.01 | 0.29 | 0.020 |
| 4 | 25Cr 4Mo 4Ni Ti | 0.021 | 0.21 | 0.002 | 0.17 | 25.29 | 3.95 | 3.98 | 0.46 | ≦0.01 | 0.04 | 0.012 |
| 5 | 29Cr 4Mo 2Ni Ti | 0.022 | 0.22 | 0.009 | 0.18 | 28.86 | 2.09 | 3.98 | 0.55 | ≦0.01 | 0.03 | 0.019 |
| 6 | 29Cr 4Mo Ti | 0.018 | 0.30 | 0.008 | 0.20 | 28.90 | 0.35 | 3.75 | 0.56 | ≦0.01 | 0.07 | 0.127 |
| 7 | 29Cr 4Mo Ti Cu | 0.021 | 0.21 | 0.001 | 0.20 | 28.75 | 0.42 | 4.01 | 0.47 | ≦0.01 | 1.01 | 0.020 |
| 8 | 29Cr 4Mo 2Ni Ti Cu | 0.023 | 0.23 | 0.003 | 0.18 | 29.81 | 1.94 | 3.81 | 0.40 | ≦0.01 | 1.00 | 0.022 |
| 9 | 29Cr 4Mo Ti low C. N | 0.003 | 0.21 | 0.004 | 0.20 | 28.90 | 0.41 | 3.97 | 0.21 | ≦0.01 | 0.012 | 0.010 |
| 10 | 29Cr 4Mo Ti Cu Low N | 0.007 | 0.21 | 0.003 | 0.20 | 28.83 | 0.40 | 3.96 | 0.26 | ≦0.01 | 1.00 | 0.008 |

It is known that the elements which promote corrosion resistance, namely chromium, molybdenum, titanium, niobium and the like have detrimental effects on other properties, such as the mechanical properties. Depending on the required application the chemical composition of the alloy must therefore be adapted in order to produce a compromise between corrosion resistance and mechanical characteristics. A badly adjusted chemical composition can in addition result in insurmountable difficulties in the fabrication of the alloy, especially as a result of the precipitation of embrittling phases during the heat tempering treatment, for example before or after cold rolling, or in the precipitation of embrittling phases during a welding operation.

It is known, furthermore, that in a chloride-containing neutral medium the pitting corrosion resistance of ferritic stainless steels increases with the chromium content. Molybdenum is a much more efficient alloying element than chromium because a Mo/Cr equivalent coefficient equal to 3.3 is generally accepted to qualify the improvement in the pitting corrosion resistance due to the action of molybdenum.

By employing samples taken from known industrial ferritic stainless steel sheets it has been verified that in a hot and concentrated chloride-containing medium the potential above which pitting corrosion takes place is proportionately higher the higher the sum % Cr+3.3×(% Mo). As a result, the pitting corrosion resistance is proportionately higher the higher the parameter % Cr+3.3×(% Mo).

It is for this reason that a chromium content higher than 28.5% and a molybdenum content higher than 3.5% have been determined in the case of ferritic stainless steel according to the present invention.

Tests conducted by starting with the experimental castings listed in the above table show that molybdenum promotes the precipitation of sigma-type embrittling phases, as shown in the diagram of FIG. 1. The curves illustrated in this diagram show the influence of the time of holding at 900° C. on the elongation A% at break at room temperature of an experimental alloy with 29Cr 4Mo 2Ni Nb and 29Cr 3Mo 2Ni Nb, that is to say of alloys with a molybdenum content equal to 3 and 4% respectively.

Figure 2:
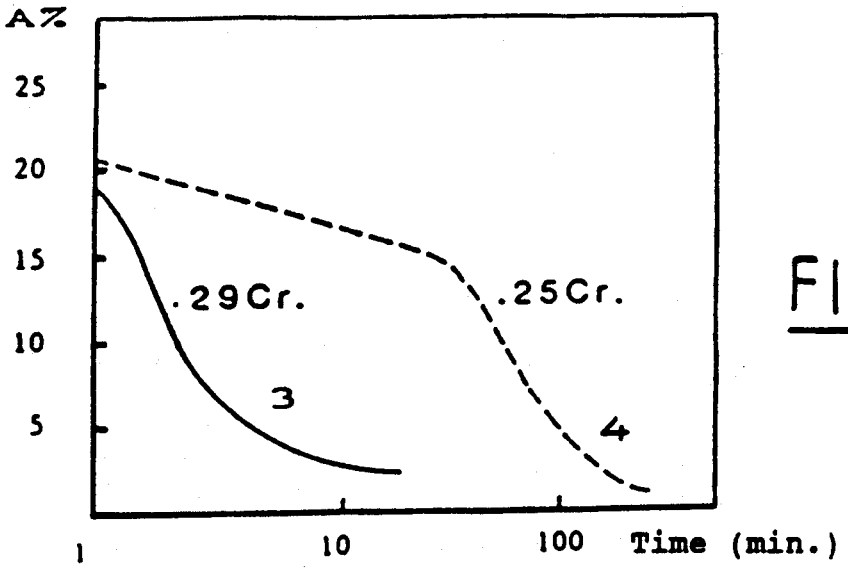
FIG. 2 is a plot similar to the plot of FIG. 1, except the steel alloys tested and plotted are, on a weight percent basis, a 29% Cr 4% Mo 4% Ni 1% Ti alloy and a 25% Cr 4% Mo 4% Ni 1% Ti alloy.

Increase in the chromium content also accelerates the precipitation of embrittling phases, as shown in the diagram of FIG. 2. The curves illustrated in this diagram show the influence of the time of holding at 900° C. on the elongation A % at break at room temperature of an experimental alloy with 29Cr 4Mo 4Ni Ti and 25Cr 4Mo 4Ni Ti.

Figure 3:
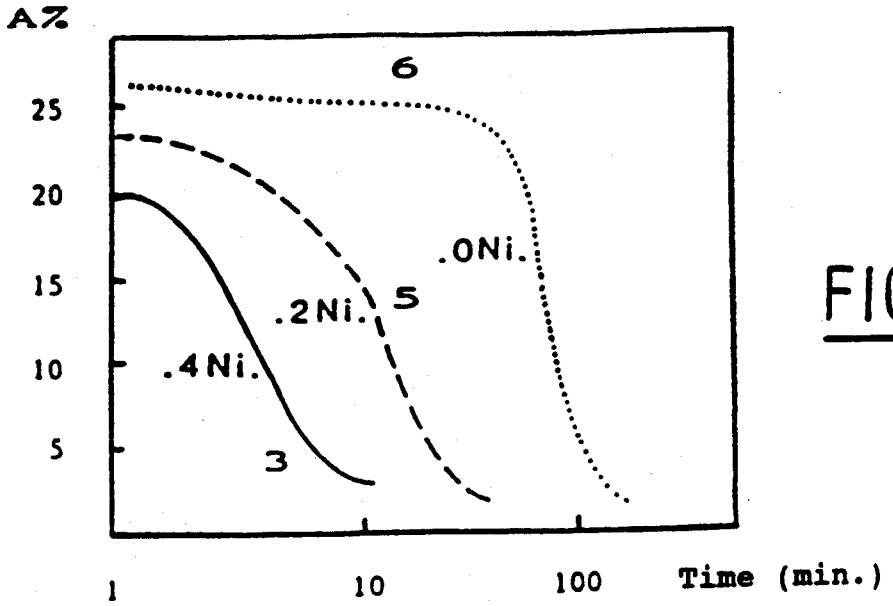
FIG. 3 is a plot similar to the plot of FIG. 1, except the steel alloys tested are the alloys, on a weight percent basis, 29% Cr 4% Mo 1% Ti, 29% Cr 4% Mo 2% Ni 1% Ti, and 29% Cr 4% Mo 4% Ni 1% Ti.

The same applies to the increase in the nickel content, as shown in the diagram of FIG. 3. The curves illustrated in this diagram show the effect of an addition of 2 to 4% of Ni on elongation A % at break at ordinary temperature of an experimental alloy with 29Cr 4Mo Ti after increasing times of holding at 900° C.

Thus, when the chromium, nickel and molybdenum contents increase, progressively shorter times of holding at 900° C. cause the precipitation of intermetallic phases which are detrimental to the ductibity [sic] of the alloy, and this results in a very appreciable or even prohibitive increase in the difficulties of industrial manufacture of these ferritic stainless steels.

It is consequently understandable that currently available industrial alloys are:

of the 25% Cr 4% Mo 4% Ni type stabilised with titanium and niobium, the lower chromium content making it possible to adopt high molybdenum and nickel contents, but to the detriment of the pitting corrosion resistance, of the 28% Cr 2% Mo 4% Ni type, stabilised with titanium or niobium, the high chromium and nickel contents necessitating a decrease in the molybdenum content to reduce the rate of precipitation of the embrittling phases.

In patent FR-A-2,377,457 the addition of up to 5% nickel is justified as an improvement in the cold toughness, that is to say of the impact strength, and of the corrosion resistance.

Figure 4:
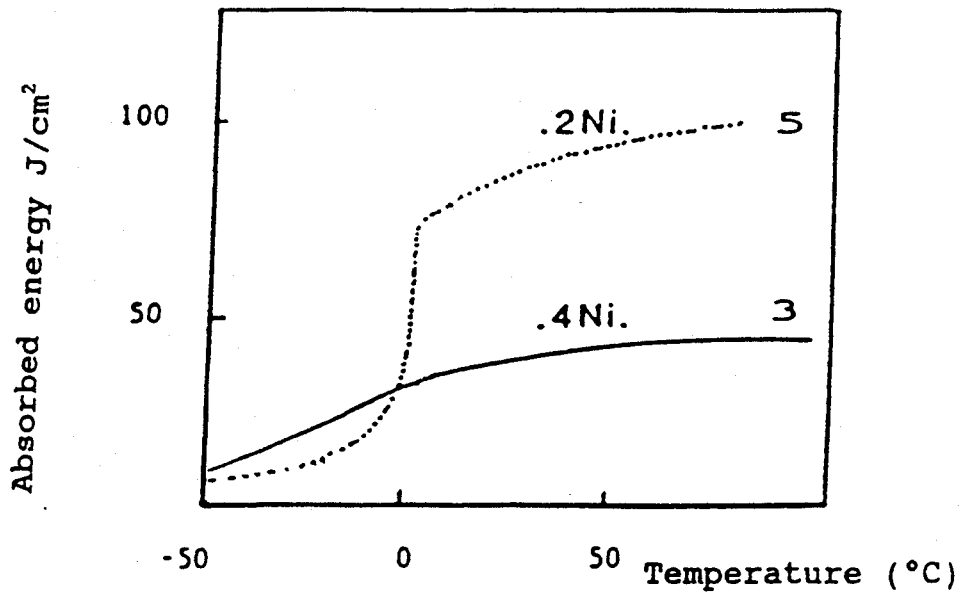
FIG. 4 is a plot of impact strength as a function of temperature and of nickel content where absorbed energy is plotted versus temperature and the nickel content is varied at 0%, 2% and 4%.
Figure 5:
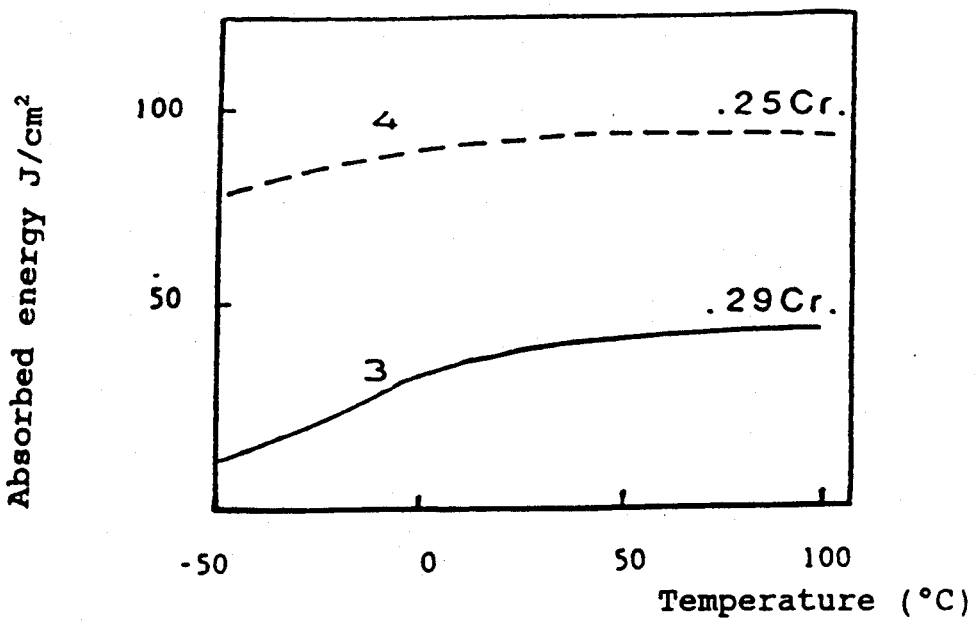
FIG. 5 is a plot of impact strength as a function of temperature on a weight percent basis, for 25% Cr 4% Mo 0.5% Ti 4% Ni and 25% Cr 4% Mo 0.5% Ti 3% Ni alloys.

Tests have shown that the improvement in the impact strength which can be obtained by the addition of 4% of nickel to a ferritic stainless steel of the 25% Cr 4% Mo 0.5% Ti type is no longer observed when the chromium content is higher than 28%, as shown in the diagram of FIG. 5. The diagram of FIG. 4 shows the change in the impact strength as a function of the temperature and of the nickel content. This diagram does not demonstrate any beneficial effects of nickel when the impact failure test on a notched specimen takes place above 0° C. in the case of a ferritic stainless steel containing approximately 29% of chromium, 4% of molybdenum and 0.5% of titanium.

In contrast to a commonly voiced opinion, the effect of nickel appears to be detrimental because the energy needed to break the specimen is, in this case, markedly lower than that of ferritic stainless steel not containing any nickel. The beneficial influence of nickel makes its appearance only in the case of lower chromium contents.

Thus, the alloy with approximately 25% of chromium, 4% of molybdenum, 4% of nickel and 0.5% of titanium does not exhibit any cold brittleness between 0 and −50° C., in contrast to the alloy containing approximately 29% of chromium, 4% of molybdenum, 4% of nickel and 0.5% of titanium, as can be seen in the diagram of FIG. 5, which shows the change in the impact failure strength as a function of the temperature and of the chromium content.

This same diagram also shows that, in the ductile state, the failure energy of the steel with 25% of chromium, 4% of molybdenum, 4% of nickel and 0.5% of titanium is markedly higher than that of the steel containing a higher chromium content and substantially similar contents of molybdenum, nickel and titanium.

Furthermore, in a chloride-containing medium the resistance to cavity corrosion, that is to say corrosion in confined spaces under the construction deposits or interstices is a use criterion of primary importance. It is known, in fact, that in a cavity a progressive acidification is produced by the formation of hydrochloric acid originating from the hydrolysis of corrosion products.

In contrast to the teaching of FR-A-2,377,457, the addition of 4% of nickel to a ferritic stainless steel stabilised with titanium or with niobium is reflected in a marked decrease in cavity corrosion resistance. In fact, examinations carried out on samples after ASTM test G48 show that steel samples containing 4% of nickel undergo a severe attack.

Figure 6:
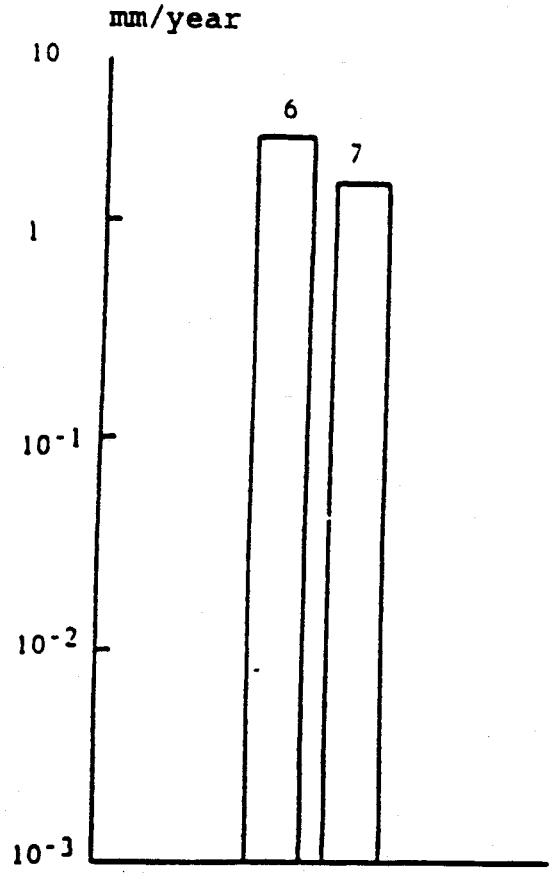
FIG. 6 shows the corrosion rate in mm/year determined by measuring the weight losses observed after 24 hours immersion of steel samples in weakly acidic chloride-containing media of 2 molar sodium chloride and 0.2 molar hydrochloric acid medium deaerated with nitrogen bubbling for the alloys 6 and 7 whose composition is tabulated on page 5.

Bearing in mind the accelerating effect of nickel on the precipitation, on heating, of the intermetallic phases which embrittle the alloy and decrease its corrosion resistance, the alloy according to the present invention contains no deliberate addition of nickel, which is considered to be a residual element. This absence of a significant quantity of nickel makes it possible to adopt high contents of chromium of more than 28.5% and of molybdenum of more than 3.5%, which are needed to obtain an optimum pitting and cavity corrosion resistance in the case of the ferritic stainless steel containing titanium and niobium. In the ferritic steel according to FR-A-2,377,457 up to 3% of copper and, preferably, from 0.5 to 2% of copper is added to the steel and this, according to this patent, increases the corrosion resistance in nonoxidising acids and in particular in hot sulphuric acid solutions. Now, according to the research carried out within the scope of the present invention and presented in the diagram of Figure 6, the results show that copper is not the source of any improvement in the corrosion resistance in weakly acidic chloride-containing media similar to the corrosive media which form in the cavities.

This diagram shows the corrosion rate (mm/year) deduced from the weight losses observed after 24 hours' immersion in a 2M NaCl-0.2M HCl medium deaerated by bubbling nitrogen through, at a temperature of 30° C., in the case of alloys 6 and 7 respectively of the above table 1.

Consequently, in the absence of nickel the addition of between 0.5 and 2% of copper neither worsens nor improves the pitting and cavity corrosion resistance in a chloride-containing medium.

According to the present invention 0.5 to 2% of copper is added to the ferritic stainless steel with high chromium and molybdenum content and containing titanium or niobium.

Figure 7:
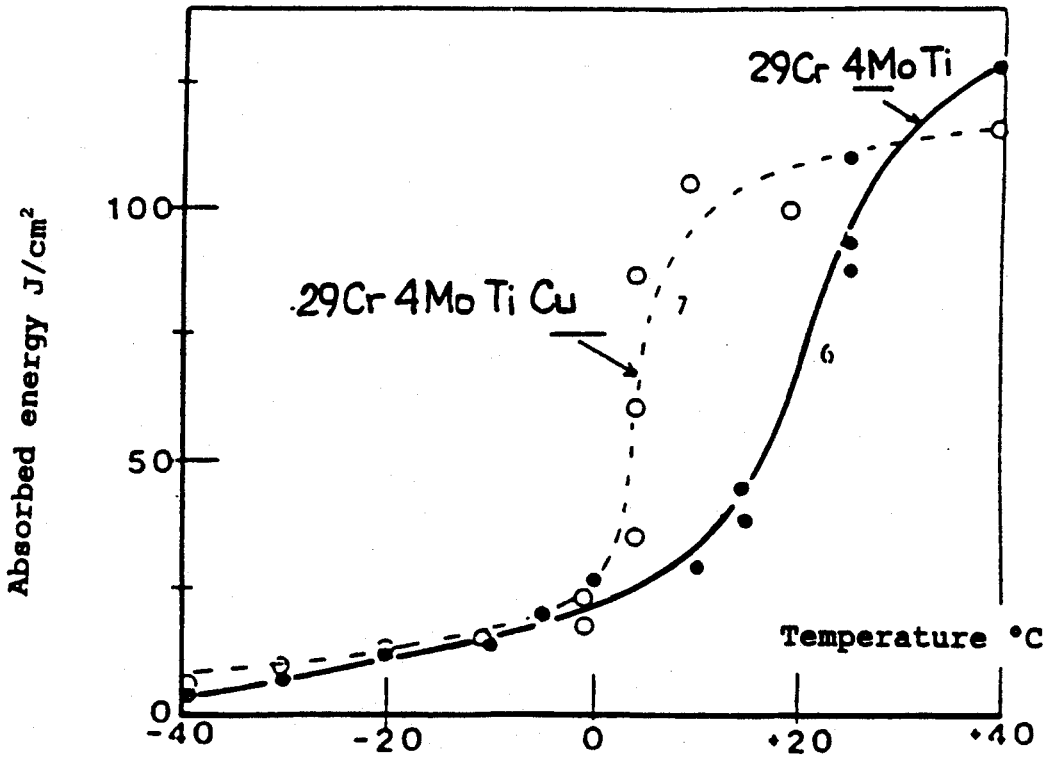
FIG. 7 is a ploy of impact strength (absorbed energy) versus temperature for a 29% Cr 4% Mo 0.5% Ti alloy with and without 1% copper showing that 1% copper lowers by 20° C. the temperature of transition between the brittle state where the brittle state corresponds to low failure energies and the ductile state corresponds to high failure energies.

The diagram of FIG. 7, in which the curves show the influence of 1% of copper on the impact strength indicates that the addition of approximately 1% of copper to an alloy containing approximately 29% of chromium, 4% of molybdenum and 0.5% of titanium is reflected in a decrease of the order of 20° C. in the temperature of transition between the brittle state characterised by very low failure energies and the ductile state corresponding to high failure energies. This results in a very appreciable improvement in the impact strength of the alloy, due to the addition of copper.

The demonstration of the beneficial effect of copper on cold brittleness constitutes an essential characteristic of the present invention. In fact, copper addition is generally recommended to improve the corrosion resistance in hot sulphuric acid solutions, as recommended by FR-A-2,377,457, and not to improve the impact strength at room temperature.

In addition to the particularly favourable effect of copper on the impact strengths, another essential special feature of the present application also lies in the demonstration of an inhibition of the precipitation of the embrittling intermetallic phases by the addition of copper, as proved by the diagram of FIG. 8, in which the curves illustrate the effect of copper addition on the kinetics of precipitation of the embrittling intermetallic phases in a ferritic stainless steel with 29Cr 4Mo and Ti. The addition of copper thus very markedly delays the appearance of embrittling phases in the 750 to 950° C. temperature region.

Furthermore, to avoid the intergranular corrosion due to the precipitation of chromium carbide and nitride resulting in the depletion of chromium in the immediate vicinity of the grain boundaries, additions of titanium or niobium are commonly made to ferritic stainless steels to fix the carbon and the nitrogen in the titanium or niobium carbide and nitride state.

However, these additions of titanium or niobium have two detrimental effects which are known qualitatively but which have not hitherto been quantified. They accelerate the precipitation of the embrittling intermetallic phases and lower the impact strength.

On lowering the carbon and nitrogen content, which makes it possible to reduce the quantity of titanium or niobium needed to fix the carbon and nitrogen, it has been found within the scope of the present invention that the impact strength of a ferritic stainless steel with a high chromium and molybdenum content was very markedly improved and that the rate of formation of embrittling intermetallic phases was simultaneously retarded.

Thus, a decrease of the order of 20° C. in the temperature of transition from the brittle state to the ductile state can be observed in the case of a 2-mm thick sheet, as shown in the diagram of FIG. 9, in which the curves show the difference in the impact strength of a superferritic 29Cr 4Mo 0.21Ti (C+N=0.013%) stainless steel and a superferritic 29Cr 4Mo 0.56Ti (C+N 0.045%) stainless steel.

Figure 10:
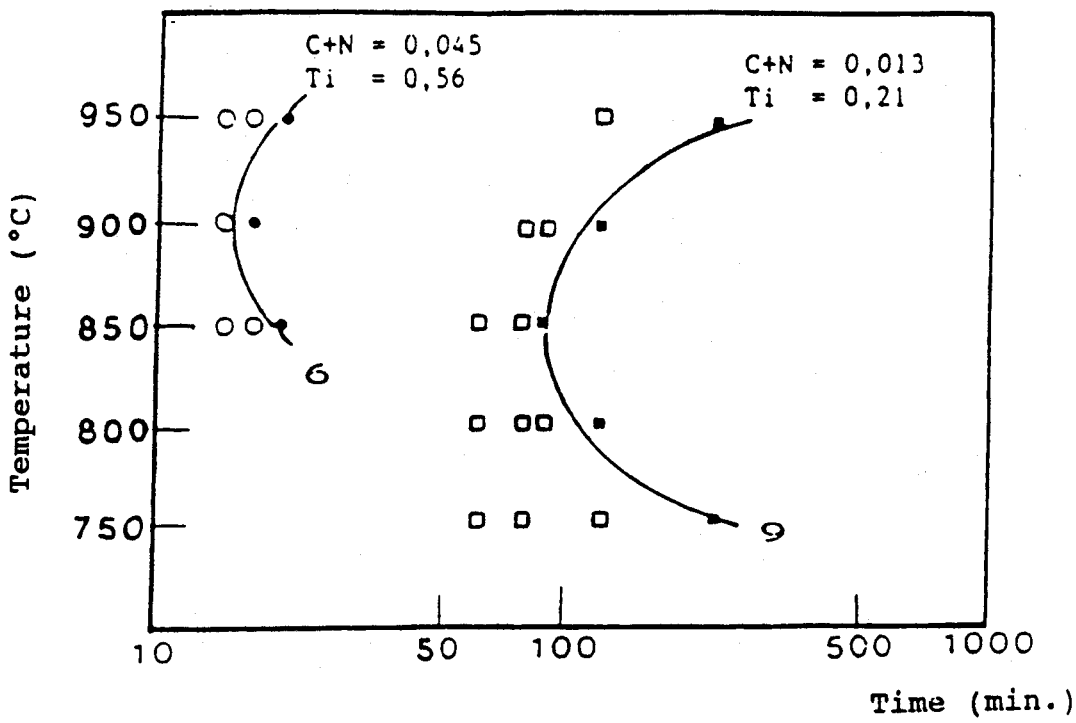
FIG. 10 is a plot of time to appearance of embrittlement phases versus the 750 to 950° C. temperature range for a 29% Cr 4% Mo 0.21% Ti alloy, where C+N=0.013%, and for a 29% Cr 4% Mo 0.45% Ti alloy where C+N=0.045%.

The range in which embrittling faces appear is additionally greatly shifted to the right, on the side of the higher isothermal hold periods, as shown by the curves in the diagram of FIG. 10, which compare the kinetics of precipitation of the embrittling phases in the case of a superferritic 29Cr 4Mo 0.56Ti (C+N=0.045) stainless steel and in the case of a superferritic 29Cr 4Mo 0.21Ti (C+N=0.013) stainless steel. After a hold of 1 hour at 900° C. an alloy with 0.018% of carbon, 0.027% of nitrogen, 28.90% of chromium, 3.75% of molybdenum, 0.035% of nickel and 0.56% of titanium now has an elongation at break of only 6% at room temperature, whereas an alloy with 0.03% of carbon, 0.010% of nitrogen, 28.90% of chromium, 3.97% of molybdenum, 0.041% of nickel and 0.21% of titanium has an elongation at break of 26%.

Figure 11:
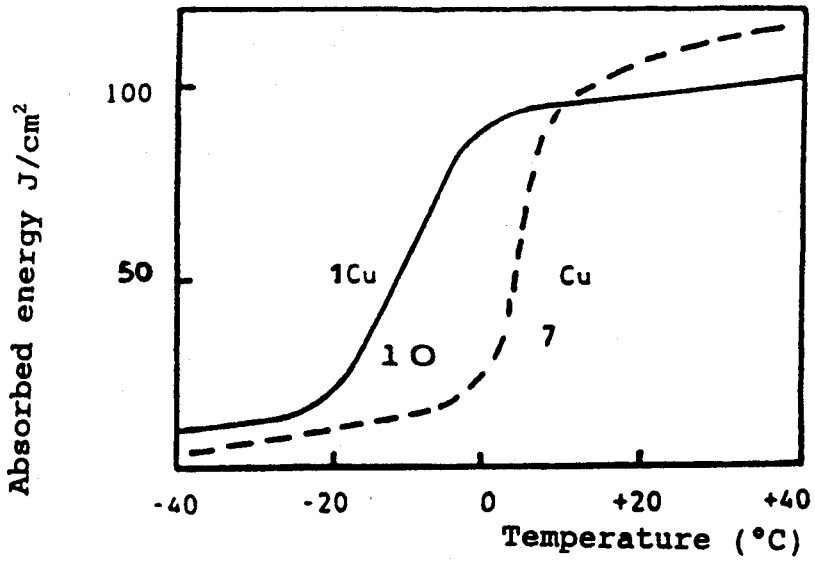
FIG. 11 is a plot as in FIG. 9 but absorbed energy versus temperature is plotted for 29% Cr 4% Mo 0.2% Ti with 0% and 1% copper. It shows that a reduction in C+N content associated with addition of copper makes it possible to obtain a temperature of transition from the brittle state to the ductile state below 0° C. for 2 mm thick steel sheets.

The reduction in the carbon and nitrogen contents associated with an addition of copper also makes it possible to obtain a temperature of transition from the brittle state to the ductile state which is well below 0° C. in the case of a 2-mm thick sheet, as shown by the diagram of FIG. 11, in which the curves make it possible to compare the impact strength of a superferritic 29 Cr 4 Mo 0.2 Ti 1 Cu (C+N=0.015) stainless steel and the impact strength of a superferritic 26 Cr 4 Mo 0.5 Ti 1 Cu (C+N=0.041) stainless steel.

Furthermore, the present invention deliberately rules out the addition of nickel, which is a costly element and which accelerates the formation of embrittling intermetallic phases and decreases the cavity corrosion resistance in a chloride-containing medium.

Bearing in mind the accelerating effect of titanium and of niobium on the formation of the embrittling intermetallic phases and their detrimental effect on the impact strength when they are combined with carbon and with nitrogen, the ferritic stainless steels according to the present invention are proportionately more resistant to impacts and have a structural stability in the region between 650 and 1000° C., which is proportionately higher the lower are the C, N, Ti and Nb contents. To optimise the intergranular corrosion resistance, the titanium and/or niobium contents to be added must be equal to the minimum needed to fix the carbon and nitrogen and to take into consideration the fact that titanium and/or niobium in solid solution in ferrite do not take part in trapping carbon and nitrogen.

Thus, the titanium content must satisfy the following equation:

$\% \text{ Ti} > 0.10 + 4 \times (\% \text{ C}) + 3.4 \times (\% \text{ N})$ and in particular the equation: $\text{Ti} > 0.15 + 4 \times (\% \text{ C}) + 3.4 \times (\% \text{ N})$ for the intergranular corrosion resistance to be optimised.

The coefficients 4 and 3.4 follow logically from the approximate values of the atomic masses of titanium (48), carbon (12) and nitrogen (14), as well as from the formulae of titanium carbide and titanium nitride, TiC and TiN respectively.

If the ferritic stainless steel is stabilised with niobium, the equation becomes:

$$\% \text{ Nb} > 0.10 + 7.7 \times (\% \text{ C}) + 6.6 \times (\% \text{ N}).$$

The atomic mass of niobium being taken as equal to 93 grams.

In the particular case corresponding to an optimum intergranular corrosion resistance the equation becomes:

$$\% \text{ Nb} > 0.20 + 7.7 \times (\% \text{ C}) + 6.6 \times (\% \text{ N}).$$

Bearing in mind the cost of titanium and of niobium and the possible detrimental effects of an excess of these elements, it is desirable to approach as closely as possible the excess of the quantity which is theoretically necessary to fix the carbon and the nitrogen.

According to the present application the addition of copper is limited to less than 2%, the precipitation of copper-rich particles resulting in an appreciable deterioration in hot forgeability when the copper content is higher than 2%.

An addition of aluminium to the ferritic stainless steel according to the present application may be added during the production for the purpose of deoxidation Consequently, the addition of between 0.5 and 2% of copper reinforces the impact strength of the alloy while reducing the rate of formation of the hard and embrittling intermetallic phases of the sigma and chi type which may form during the manufacturing or welding heat treatments. This leads to the possibility of producing an alloy stabilised with titanium or niobium with a very high content of chromium of between 28.5 to 35% and of molybdenum of between 3.5 and 5.5%, which are indispensable for obtaining maximum corrosion resistance while reducing to a minimum the difficulties in manufacture and the risks of deterioration in other final properties.

As a result of its properties, the ferritic alloy according to the present invention is particularly suited for use in the form of sheets and strips whose thickness may be greater than that generally employed in practice (less than one mm) in the case of a ferritic stainless steel of the same chromium and molybdenum content, containing titanium or niobium.

The stainless steel described by the present invention is particularly intended for the manufacture of welded tubes for heat exchangers conveying chloride-containing water. It may be produced, for example, using the electrical steel plant process, AOD and/or vacuum refining, continuous casting and hot rolling on a strip rolling mill.

We claim:

1. Ferritic stainless steel resisting corrosion in neutral or weakly acidic chloride-containing media, ductile and impact-resistant, consisting essentially of the following chemical composition by weight:

28.5 to 35% of chromium,
3.5 to 5.50% of molybdenum,
0.5 to 2% of copper,
less than 0.50% of nickel,
less than 0.40% of manganese,
less than 0.40% of silicon,
less than 0.030% of carbon,
less than 0.030% of nitrogen,
a percentage of titanium and/or niobium of at least 0.10% and lower than 0.60% and satisfying respectively the relations:

$$\% \text{ Ti} > 0.1 + 4(\% \text{ C}) + 3.4(\% \text{ N})$$

and/or $$\% \text{ Nb} > 0.1 + 7.7(\% \text{ C}) + 6.6(\% \text{ N}),$$

the remainder being iron and impurities resulting from the melting of the substances needed for the production.

2. Ferritic stainless steel according to claim 1, wherein it contains:

less than 0.010% of carbon and less than 0.015% of nitrogen, the sum of carbon and nitrogen being less than 0.025%.

3. Process for the production of a ferritic stainless steel resisting corrosion in neutral or weakly acidic chloride-containing media, ductile and impact-resistant, consisting essentially of the following chemical composition by weight:

28.5 to 35% of chromium,
3.5 to 5.50% of molybdenum,
0.5 to 2% of copper,
less than 0.50% of nickel,
less than 0.40% of manganese,
less than 0.40% of silicon,
less than 0.030% of carbon,
less than 0.030% of nitrogen,
a percentage of titanium and/or niobium of at least 0.10% and lower than 0.60% the remainder being iron and impurities resulting from the melting of the substances needed for the production from which a steel strip is formed, which is rolled when hot, wherein the hot-rolled steel strip is subjected to tempering at a temperature of between 900 and 1200° C., the steel strip is then subjected to a first cold rolling followed by an intermediate tempering at a temperature of between 900 and 1200° C. and finally the steel strip is subjected to a second cold rolling followed by a final tempering at a temperature of between 900 and 1200° C.

4. Process according to claim 3, wherein the intermediate tempering and the final tempering are performed continuously for 20 seconds to 5 minutes.

5. Process according to claim 3, wherein the temperings are followed by rapid cooling.

* * * * *